US005524293A

United States Patent [19]

Kung

[11] Patent Number: 5,524,293

[45] Date of Patent: Jun. 11, 1996

[54] COOLING VEST

[76] Inventor: King Y. Kung, Flat A, 25th Floor, Block 9, Nam Fung Sun Chuen, Quarry Bay, Hong Kong

[21] Appl. No.: 237,111

[22] Filed: May 3, 1994

[51] Int. Cl.[6] ..... A41D 1/04; A41D 13/00

[52] U.S. Cl. ..... 2/102; 2/94; 2/250

[58] Field of Search ..... 2/102, 94, 95, 2/97, 108, 247, 51; 607/108, 109, 112, 114

[56] References Cited

U.S. PATENT DOCUMENTS

| | | | |
|---|---|---|---|
| 1,195,738 | 8/1916 | Rose | 2/97 |
| 1,448,940 | 3/1923 | Pohlkotte | 2/94 |
| 2,403,676 | 7/1946 | Modlinski | 2/94 |
| 2,428,477 | 10/1947 | Thompson | 2/247 |
| 3,950,789 | 4/1976 | Konz et al. | 2/97 |
| 4,601,067 | 7/1986 | Buonassissi | 2/94 |
| 4,696,066 | 9/1987 | Ball et al. | 2/102 |
| 5,031,244 | 7/1991 | Inagaki | 2/102 |
| 5,038,779 | 8/1991 | Barry et al. | 2/102 |
| 5,063,614 | 11/1991 | McSheffery | 2/102 |
| 5,072,455 | 12/1991 | St. Ours | 2/102 |
| 5,146,625 | 9/1992 | Steele et al. | 2/102 |
| 5,243,706 | 9/1993 | Frim et al. | 2/102 |
| 5,305,471 | 4/1994 | Steele et al. | 2/102 |

FOREIGN PATENT DOCUMENTS

| | | | |
|---|---|---|---|
| 1315340 | 12/1963 | France | 2/94 |
| 0229307 | 11/1985 | Germany | 2/102 |

OTHER PUBLICATIONS

"Liquid–Cooled Clothing for Hot Mine Rescue Work," *Technology News,* No. 65, Apr. 1979. (2/102).

*Primary Examiner*—Amy B. Vanatta
*Attorney, Agent, or Firm*—Gunn, Lee & Miller

[57] ABSTRACT

A cooling vest arranged with a pocket between a denim outer layer and a linen inner layer to receive a flexible vessel containing separate pockets filled with water. The vessel is releasably attachable to the vest and in use the water is cooled or frozen before the vessel is fitted in the pocket. The vest is used for cooling the body of a user either during recreation, or while working in hot conditions or a person who is allergic to dust particles mixed in air emitted from electric air-conditioner or a sick person to reduce his abnormal body temperature or when sickness raises his temperature above normal body temperature.

5 Claims, 1 Drawing Sheet

COOLING VEST

BACKGROUND OF THE INVENTION

The invention relates to vests.

The invention relates more particularly but not exclusively to vests for specific use to cool the body of a healthy person during indoor or outdoor recreation or while working in hot conditions, or a person who is allergic to dust particles mixed in air emitted from electric air-conditioners, or a sick person to reduce his abnormal body temperature.

SUMMARY OF THE INVENTION

According to the invention there is provided a cooling vest comprising an upper body cover with a pocket extending over a substantial part of the cover, and a flexible laminar vessel for cooling fluid arranged to fit and be supported in the pocket so as to extend and lie generally flat against the body of a wearer.

A pocket may be provided in both a front and a rear body cover and a separate vessel in each pocket.

The vessel may be formed of a number of separate fluid compartments.

The compartments are filled with water.

The vessel is preferably supported adjacent a top edge by the vest. The top edge can be provided with apertures to receive studs to attach the top edge to the vest.

A cooling vest according to the invention will now be described by way of example with reference to the accompanying drawings.

DESCRIPTION OF THE PREFERRED EMBODIMENT

Figure 1:
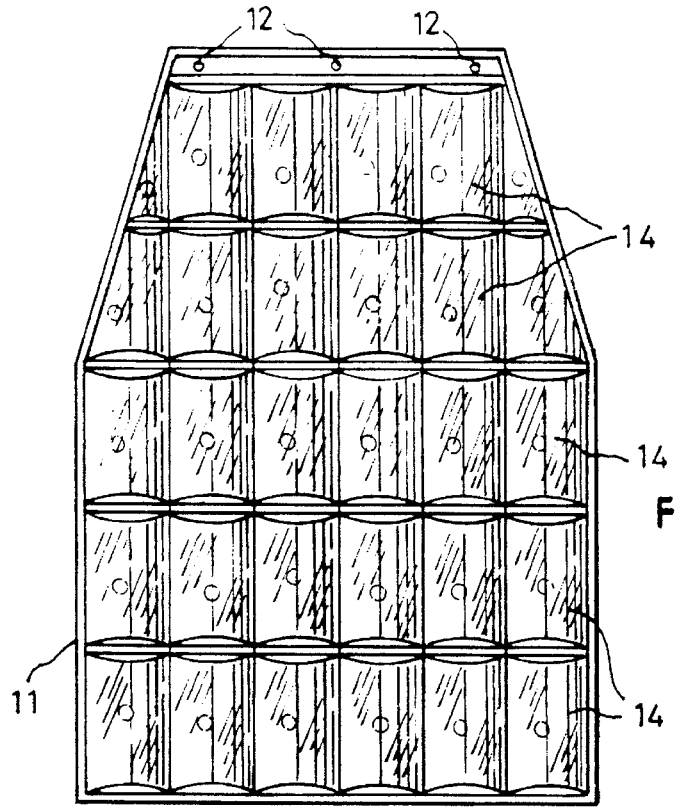
FIG. 1 is a plan view of a flexible laminar fluid vessel for the vest.
Figure 2:
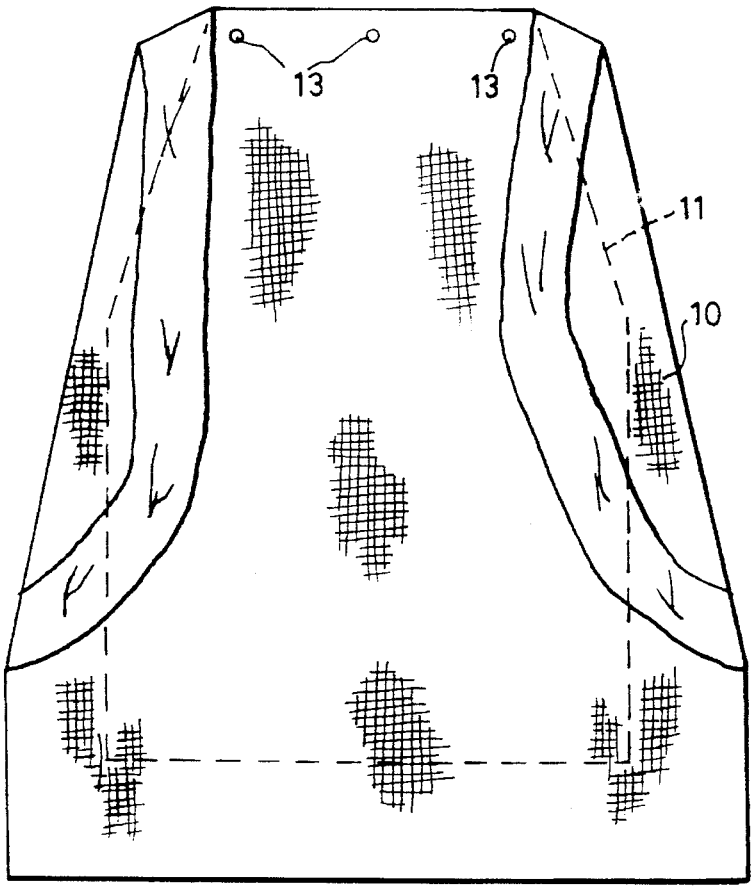
FIG. 2 is a front plan view of the vest.

Referring to the drawings, the vest 10 is formed of denim material with an inner lining of rough linen. This provides a pocket (shown by a broken line) between the denim and linen material to receive the laminar vessel 11. The vessel 11 is provided with three apertures 12 which in use are lined up with apertures 13 positioned at the top rear shoulder part of the vest 10. Rubber studs (not shown) fit through the apertures 12 and 13 to releasably hold the vessel in position and so that the vest serves to support the vessel 11 in use. This means the vessel will lie generally over and against the whole or a substantial part of the rear upper body of the user.

The vessel 11 is formed of a number of separate compartments 14 attached together by plastic sheeting. In fact the vessel 11 is conveniently formed by sealing two plastic sheets together along joining strips in a manner to form the separate compartments as desired. Each compartment is filled with water or other suitable fluid, such as glycerine, which can be frozen or cooled down below ambient temperatures. It is normally beneficial or usual to cool the water or other fluid by placing the vessel 11 in a refrigerator, for example, when not in use. Indeed, especially when used for medical treatment, a number of replacement vessels 11 can be stored in a refrigerator for use as required one after the other.

Vests according to the invention can be worn quite normally and when it is required to cool the user, a vessel 11 can be easily fitted in the pocket of the vest to lie against the user's body. It will be appreciated that, although more often as described only a rear pocket is provided for the vessel 11, the vest may have a front pocket or both a rear pocket and a front pocket if desired.

It will be appreciated that the vessel may remain in the vest and the vest and vessel placed in a refrigerator to cool down the water or other fluid if desired.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A cooling vest comprising:

an upper body cover with a pocket extending over a substantial part of said cover; and a flexible, sealed, laminar vessel containing cooling fluid, said sealed vessel arranged to fit and be releasably suspended in said pocket along only a top edge of said sealed vessel by a top edge of said vest so as to allow said Sealed vessel to extend and lie generally flat against the body of a wearer when worn by said wearer.

2. The cooling vest according to claim 1, wherein said pocket is a first pocket in a front of said cover, said cover further comprising a second pocket in a rear of said cover and a second, separate vessel in said second pocket.

3. The cooling vest according to claim 1, wherein said vessel is formed of a number of separate fluid compartments.

4. The cooling vest according to claim 3, wherein said compartments are filled with water.

5. The cooling vest according to claim 1, wherein said top edge of said vessel and said vest are provided with apertures to receive studs to attach said top edge of said vessel to said top edge of said vest.

* * * * *